United States Patent [19]

Hofstetter

[11] 4,189,789

[45] Feb. 26, 1980

[54] URINE COLLECTION CONTAINER WITH COUPLING FOR SUSPENSION LINE

[75] Inventor: Jack H. Hofstetter, Anaheim, Calif.

[73] Assignee: American Hospital Supply Corporation, Evanston, Ill.

[21] Appl. No.: 936,758

[22] Filed: Aug. 25, 1978

[51] Int. Cl.[2] ..... A47K 11/02; B42F 13/04

[52] U.S. Cl. ..... 4/144.1; 248/318; 224/45 P; 224/56

[58] Field of Search ..... 4/144, 144.1, 144.2, 4/144.3, 144.4; 248/318, 328, 95, 99; 128/275, 295; 224/46 R, 51, 54, 55, 56, 45 P

[56] References Cited

U.S. PATENT DOCUMENTS

| | | | |
|---|---|---|---|
| 2,230,951 | 2/1941 | Hyde | 248/318 |
| 4,093,169 | 6/1978 | Winchell | 248/318 |

*Primary Examiner*—Houston S. Bell

*Attorney, Agent, or Firm*—Larry N. Barger

[57] ABSTRACT

A urine collection bag with a rigid handle connected to the bag, and this handle has a pair of spaced apart openings with lead-in slots oriented relative to the openings for easy nonthreading insertion of a flexible suspension line which is retained in the opening for hanging the container.

6 Claims, 2 Drawing Figures

2000ML
1000ML
100ML

URINE COLLECTION CONTAINER WITH COUPLING FOR SUSPENSION LINE

BACKGROUND

Flexible line hangers with attached hooks have been known for hanging urine collection bags, as shown in U.S. Pat. Nos. 3,090,968, 3,186,410 and 3,602,223. Since these drainage bags are disposed of after a single patient use to reduce the risk of cross-contamination between patients, the hanging system must be very inexpensive. Although special bed rail clamps, etc. have been devised for fitting most beds, the flexible line or cord has been used where a greater tolerance is needed for the various sizes and shapes of bed rails and other structure from which the urinary drainage container is suspended.

In the past, there has been a problem of the tedious labor involved in assembling the flexible cord hangers to the urinary drainage containers. This often required a laborious threading of the cord through holes in the flexible bag and subsequently securing ends of the cord into a loop. U.S. Pat. No. 3,602,223 has a transverse stiffener sealed in an upper end of the bag, and the bag has wide notches at its sides to provide protruding ears around which the hanging cord could be looped. These ears, specified at 39 in this patent, could easily become dislodged from the cord through movement of the bag, etc. This is why this patent still requires the tedious threading assembly of the cord through holes 40 in the bag.

SUMMARY OF THE INVENTION

The present invention overcomes the problem mentioned above by providing a rigid handle on the container that has a pair of spaced apart openings with slots leading to these openings from edges of the handle. These slots are peripherally oriented relative to the openings for easy nonthreaded insertion of a suspension cord which is retained in these openings for hanging the container. Thus, the handle cannot readily fall off the cord as the bag is moved.

THE DRAWINGS

FIG. 1 is a front elevational view of a drainage container with a rigid handle having a preattached suspension cord; and FIG. 2 is an enlarged fragmentary view of the cord receiving structure of the handle.

DETAILED DESCRIPTION

Figures 1, 2:
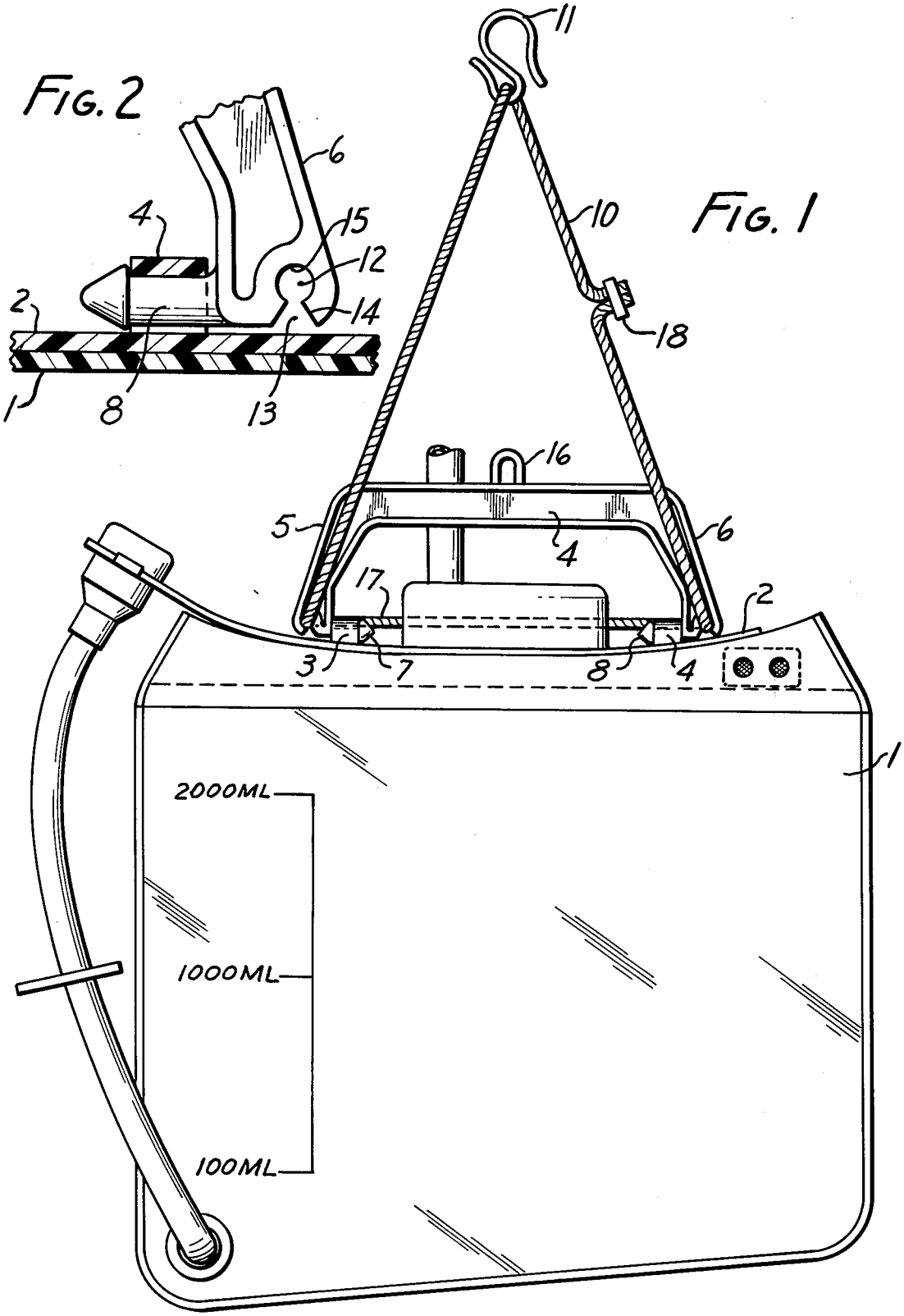

FIG. 1 shows a flexible drainage bag 1 which has a stiffening panel 2 at its upper end, and this stiffening panel has a pair of pivot journals 3 and 4. A rigid handle includes a top grasping bar 4 connected to spaced apart legs 5 and 6, and these legs have pivot shafts 7 and 8 received in journals 3 and 4. Thus, the rigid handle provides firm control over the flexible bag that may contain as much as 2,000 ml (approximately ½ gal.) of urine. During the collection procedure, the bag can be supported from a bed rail or the like by a flexible cord 10 which is looped around such bed rail and secured to itself by hook 11.

The handle structure which permits easy nonthreaded assembly of cord 10 is shown in FIG. 2. Here a lower portion of the handle's leg 6 has a shaft 8 pivotally received in journal 4. Also, at the lower end portions of leg 6 is an opening 12 for receiving cord 10. A slot 13 extends downwardly from the opening 12 and the slot is defined by opposed walls, such as 14, that taper inwardly toward opening 12. This can provide a snap-in retainer structure for a cord that is approximately the same diameter as opening 12. Opening 12 is defined by an inner wall surface 15 that is generally C-shaped.

Also, helping to retain cord 10 in opening 12 is stiffening panel 2 that spans an outer end of slot 13. The stiffening panel and its attached bag 1 are of a thermoplastic material sufficiently flexible to be manually distorted downwardly so the cord then can be readily removed from opening 12, if desired. For instance, the cord could be sold preassembled to the handle as shown in FIG. 1. Alternatively, the cord could be provided as an optional item. Some users that had a particular bed model that would accept a hook structure could use a hanging hook (not shown) inserted in an inverted U-shaped member integrally formed with a rigid handle. Even when the hanging cord 10 is preassembled to the rigid handle, the opening 12 adjacent a lower end of the handle prevents a transverse section 17 of the cord from interfering with the top grasping 4 of the handle.

The handle structure shown in FIGS. 1 and 2 provide considerable flexibility to both the manufacturer and user in attaching and detaching the cord 10. Since there is no threading assembly required through holes, the cord can be secured in a loop by clip 18 prior to connection to the rigid handle. The cord is simply snapped into the two openings in the handle. The orientation of slot 13 prevents the hanging tension on cord 10 from pulling it out of such slot. Preferably, the slot is narrower than opening 12 and adjacent a panel, such as 2, to help prevent inadvertent dislodgement of cord 10 from opening 12.

In the foregoing description, a specific example has been used to describe the invention. However, it is understood that those skilled in the art can make certain modifications to this example without departing from the spirit and scope of the invention.

I claim:

1. A urine collection container, wherein the improvement comprises: a rigid handle with a grasping bar and two spaced apart depending legs which have lower end portions pivotally connected to the container; each leg having an opening adjacent to a lower end of the leg and a slot leading to this opening from an edge of the handle, and each slot being peripherally oriented relative to such opening and having a shape for nonthreaded insertion of a suspension line adapted to suspend the container without pulling out of the handle opening.

2. A urine collection container as set forth in claim 1, wherein the slots extend downwardly from the openings.

3. A urine collection container as set forth in claim 2, wherein the container has a distortable wall adjacent an outer end of the slot.

4. A urine collection container as set forth in claim 1, wherein the slots are defined by sides that converge inwardly toward the opening.

5. A urine collection container as set forth in claim 1, wherein the opening is defined by an inner surface that is generally C-shaped.

6. A urine collection container as set forth in claim 1, wherein there is a suspension line loop preconnected to the handle's opening.

* * * * *